US005474469A

United States Patent [19]

Vassallo et al.

[11] Patent Number: 5,474,469

[45] Date of Patent: Dec. 12, 1995

[54] ELECTROSURGICAL CORD AND ADAPTER ASSEMBLIES

[75] Inventors: Charles Vassallo, Oxford, Conn.; Richard P. Dickerson, Rockaway Township, N.J.

[73] Assignee: American Cyanamid Company, Wayne, N.J.

[21] Appl. No.: 139,601

[22] Filed: Oct. 18, 1993

[51] Int. Cl.[6] ..... H01R 13/73

[52] U.S. Cl. ..... 439/568; 439/909

[58] Field of Search ..... 439/625, 568, 439/577, 909, 750

[56] References Cited

U.S. PATENT DOCUMENTS 3,045,201 7/1962 Hall ..... 439/172

*Primary Examiner*—Gary F. Paumen

*Attorney, Agent, or Firm*—Charles F. Costello; Ari M. Bai

[57] ABSTRACT

An electrosurgical cord adapter assembly designed for use in conjunction with an electrosurgerical device includes an electrically connecting portion for receiving and electrically connecting an electrical pin of the electrosurgical device and an electrical cord, and an insulating boot with two opposing lateral sides integrally formed with the electrically connecting portion and having a closed back end and an open front end. The boot is designed to cover electrically conductive parts on a handle assembly or surgeon-manipulable portion of the electrosurgical device. Alternatively, the electrical cord can be integrally formed with the electrically connecting portion.

4 Claims, 3 Drawing Sheets

ELECTROSURGICAL CORD AND ADAPTER ASSEMBLIES

BACKGROUND OF THE INVENTION

1. Field of the Invention

This invention relates generally to electrosurgical devices for use in endoscopic surgical procedures, and more particularly to a safety device to be used with endoscopic electrosurgical devices to protect the surgeon/user from electrical shock.

Electrosurgical devices typically use a distally-attached surgical tool, such as a pair of actuating jaws, for cutting or dissecting tissue, blood vessels or other internal body parts, and are often capable of providing an electrical charge for cauterizing the severed body part. Cauterizing seals the severed ends of, for example, a capillary and stops the bleeding. Endoscopic electrosurgical devices are used in non-invasive or minimally-invasive surgical procedures.

A conventional endoscopic electrosurgical device includes a handle assembly connected to a slender, elongated shaft portion insertable into a tube, known as a cannula, placed in the patient's body. For example, FIG. 5 is a partial side view of the electrosurgical adapter of the present invention positioned on a conventional endoscopic electrosurgical device. The illustrated conventional electrosurgical device is marketed and sold under the PRESTIGE™ line of electrosurgical dissectors and includes a handle assembly 11 having a squeezable handle 13 pivotable about a fulcrum pin in 15. An elongated shaft 17, which is only partially shown in FIG. 5, typically has a surgical tool, such as a pair of scissors, secured at its distal end and a push rod extending within the shaft and connected between the pair of scissors and an actuator (unshown) mounted in the handle assembly. The actuator is actuated by squeezing the handle causing the push rod to axially slide in the shaft to actuate the pair of scissors. An electrical pin 19 extends from the handle assembly and may be connected to an electrical cord for supplying electricity to the surgical tool mounted at the distal end of the shaft to perform the cauterizing function.

Many of the parts of conventional electrosurgical devices are made of plastic. However, in addition to the electrical connecting pin, the surgical tool, and means for carrying electrical current therebetween, at least the fulcrum pin and the actuator are also usually made of metal and are thus capable of carrying electrical current. A potentially dangerous problem may exist in certain situations where some conventional devices are used because electrical current can leave its intended electrical path by arcing or leaking. The current may then travel directly to the surgeon or to the other electrically conductive components such as the actuator or fulcrum pin and then to the surgeon. If the surgeon is not insulated properly, for example, if the surgeon is grounded at the same potential as the electrical generator, electrical current could flow through the surgeon and cause an electrical shock.

Besides the potential harm to the surgeon, the electrical shock could cause the surgeon to move suddenly and jerk the electrosurgical device positioned in the patient's body, possibly harming the patient.

2. Description of the Prior Art

Many conventional electrosurgical devices do not provide means for electrically isolating the surgeon/user from the electrically conductive parts on the electrosurgical device, and instead rely solely on the surgeon being insulated. However, as discussed above, if the surgeon is not properly insulated, electrical current could flow through the surgeon providing an electrical shock and possibly causing the surgeon to suddenly move the electrosurgical device within the patient's body.

While the possibility of the surgeon receiving such an electric shock is considered remote, it is still desirable to improve upon the conventional electrosurgical device design. Accordingly, it is useful to provide increased safety in endoscopic electrosurgical procedures, by providing an improvement for endoscopic electrosurgical devices that insulates the surgeon from the device to minimize the possibility of receiving an electrical shock during use.

SUMMARY OF THE INVENTION

It is a principal object of the present invention to provide a shock-resistant endoscopic electrosurgical device.

Accordingly, it is an object of the present invention to provide a safety device for supplying an electrical current to an electrosurgical device while protecting the surgeon/user from electrical shock when using the device.

It is another object of the present invention to provide a one-piece electrosurgical cord that can fit a conventional endoscopic electrosurgical device and cover electrically conductive parts on the device.

It is a further object of the present invention to provide an adapter for receiving an electrical cord that can fit a conventional endoscopic electrosurgical device and cover electrically conductive parts on the device.

These and other objects are achieved by electrosurgical cord and adapter assemblies in accordance with the present invention, which in one aspect comprises an electrosurgical cord including an electrical connecting portion defining a channel open at a first end for receiving an electrical pin on the electrosurgical device. An electrical cord is integrally formed with the electrical connecting portion and is electrically connected to the electrical pin on the electrosurgical device, and an insulating boot is integrally formed with the electrical connecting portion. The boot has two opposing lateral sides with a closed back end and an open front end for fitting over the electrosurgical device.

In another aspect of the invention, an electrosurgical adapter assembly comprises an electrical connecting portion defining a channel open at a first end for receiving an electrical pin on the electrosurgical device and also has an electrical pin extending therefrom for receiving an electrical cord. An insulating boot with two opposing lateral sides extends from the electrical connecting portion and has a closed back end and an open front end for fitting over the electrosurgical device.

In yet another aspect of the invention, an electrosurgical cord assembly comprises electrical connecting means for receiving an electrical pin from the electrosurgical device. The connecting means includes an integrally formed electrical cord electrically connected to the electrical pin, and insulating means for covering electrically conductive parts on a handle assembly of the electrosurgical device. The insulating means is integrally formed with the electrical connecting means.

In still another aspect of the invention, an electrosurgical adapter assembly comprises electrical connecting means for receiving and electrically connecting an electrical pin on the electrosurgical device and an electrical cord and insulating means for covering electrically conductive parts on a handle assembly of the electrosurgical device, the insulating means being integrally formed with the electrical connecting means.

These and other objects, aspects, features and advantages of the present invention will become apparent from the following detailed description of the preferred embodiments taken in conjunction with the accompanying drawings.

DESCRIPTION OF THE PREFERRED EMBODIMENTS

Figure 1:
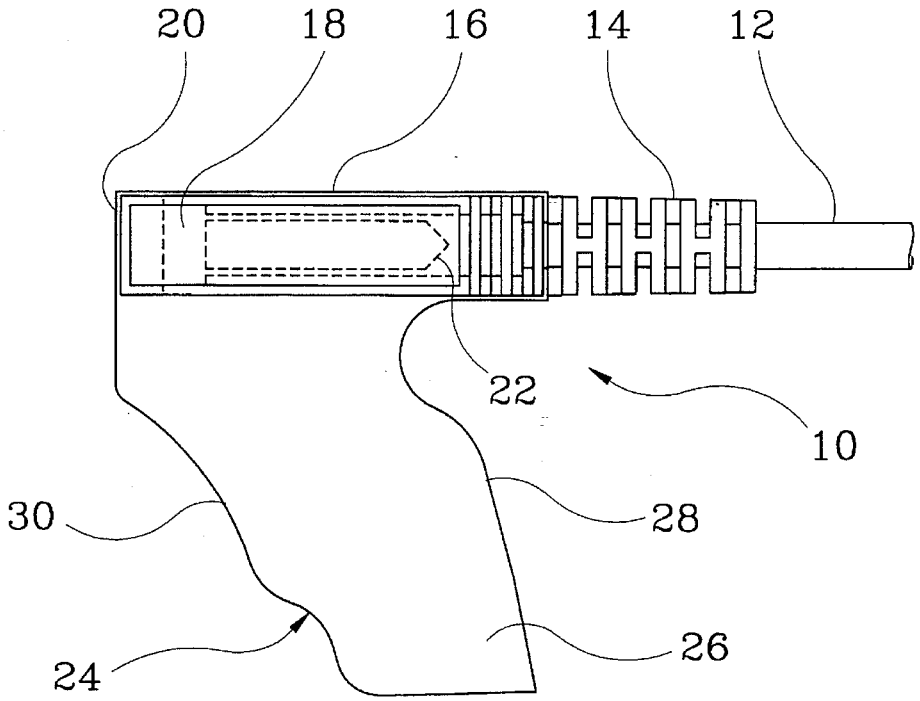
FIG. 1 is a side elevational view of a monopolar electrosurgical cord and protective boot assembly in accordance with a first embodiment of the invention.

FIG. 1 shows a reusable electrosurgical cord and insulating boot assembly 10 designed in accordance with a first embodiment of the invention. The one-piece assembly is integrally formed with an electrical cord 12 and flex protector, or flexible collar, 14 leading into an electrical connecting portion 16. The electrical connecting portion has a channel 18 open at its front or distal end 20 for receiving an electrical pin 19 from electrosurgical device 11, shown in FIG. 5. A female conductive socket 22 is disposed within the channel and electrically connects the electrical pin with the electrical cord.

For ease of explanation the electrical connections between the cord and adapter assemblies of the present invention and the electrosurgical devices in conjunction with which they are to be used are considered to be monopolar. However the principles of the invention can be equally well adapted to bipolar or other multipolar systems.

An insulating boot 24 extends downwardly from the electrical connecting potion and includes two opposing lateral sides 26 with a closed back end 28 and an open front end 30. The lateral sides are shaped to cover all electrically conductive parts on the handle assembly, that is the surgeon-manipulable portion, of the electrosurgical device.

Figure 5:
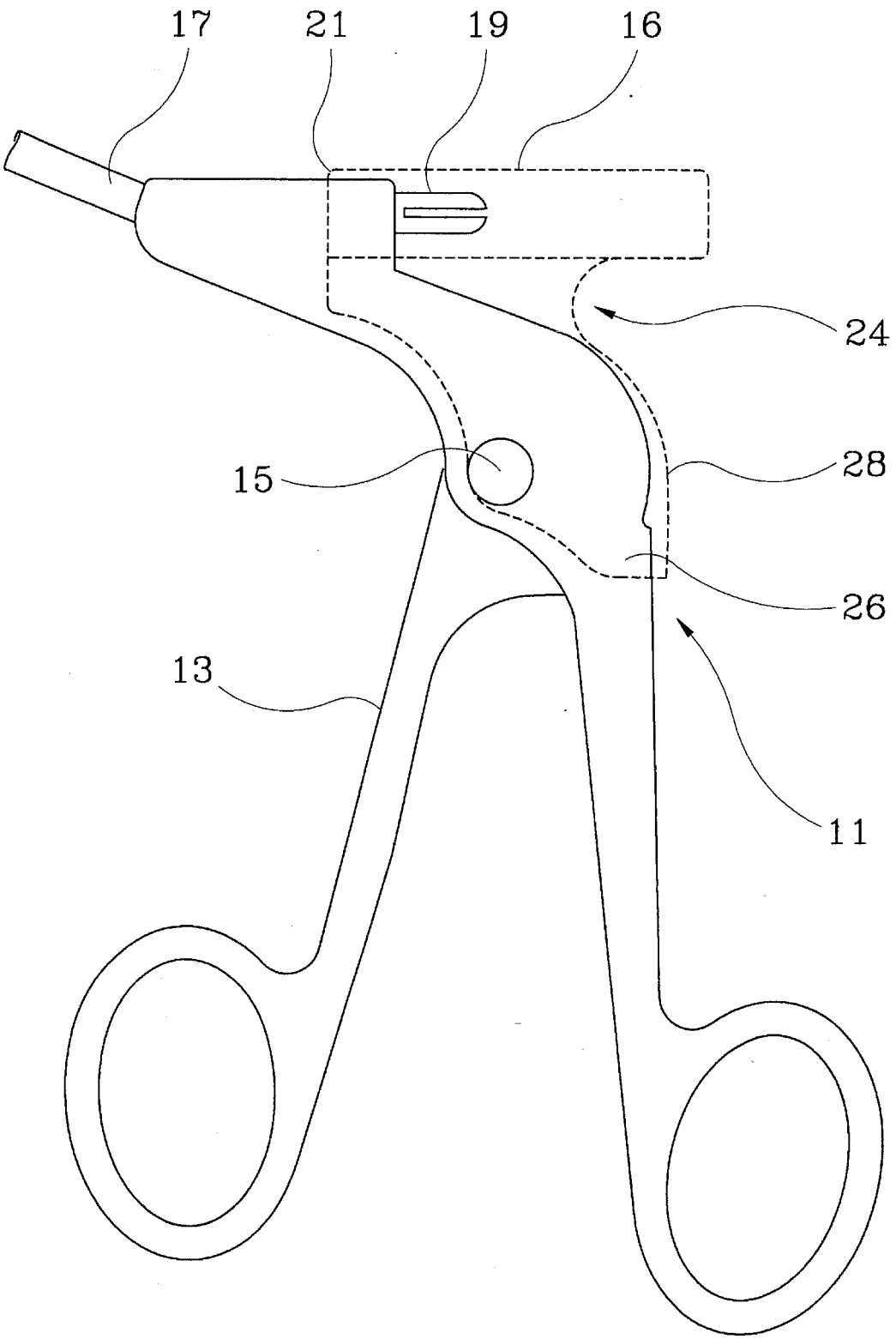
FIG. 5 is partial side elevational view of a proximal portion of an electrosurgical device fitted with an electrosurgical cord of the present invention.

Referring in greater detail on FIG. 5, a phantom view of the insulating boot 25 shows it to be shaped to snugly fit over the top portion of handle assembly 11. (For the sake of simplicity, the electrical cord is not shown in FIG. 5.) Fulcrum pin 15 is covered on one or both sides by opposing lateral side 26 of the boot and the actuator is completely enclosed between the lateral sides 26 and closed back end 28. In this way, the possibilities are minimized of current arcing or leaking from its intended path and passing from the conductive parts to the surgeon operating the electrosurgical device. Any additional conductive parts on the handle assembly, such as connecting screws or pins, can also be completely covered by lateral sides 26 of the boot. It will be understood that the particular shape of the part and specifically the lateral sides, can be designed for different particular electrosurgical device configurations.

Electrical pin 19 fits in the female socket positioned deep within the channel to receive electrical current from the electrical cord. The front end 20 of the channel acts as a shroud to protect the surgeon/user from current arcing or leaking from the electrical pin.

Figure 2:
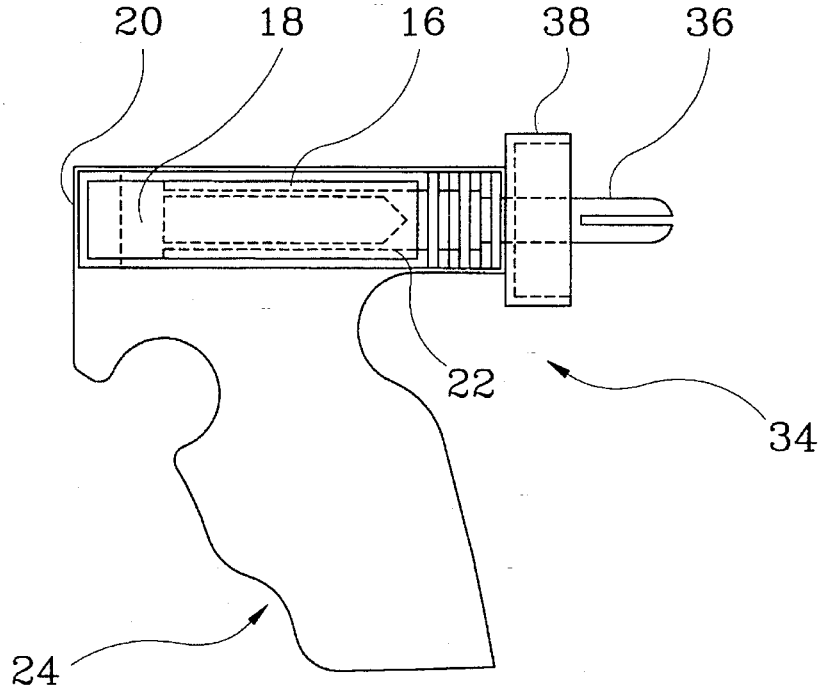
FIG. 2 is a side elevational view of a monopolar electrosurgical cord adapter and protective boot assembly in accordance with a second embodiment of the invention.
Figure 3:
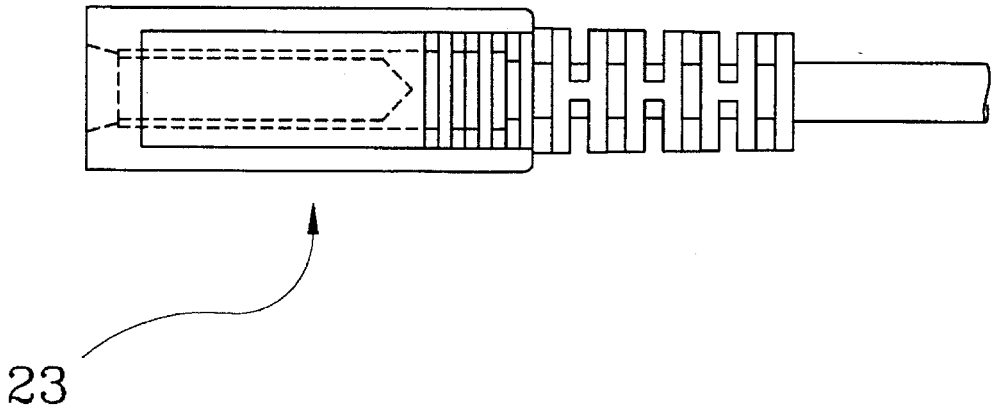
FIG. 3 is a side elevational view of a universal cord to be fitted on the cord adapter shown in FIG. 2.

The second embodiment of the invention is shown in FIG. 2 and differs from the first embodiment in that it does not include an integrally-connected electrical cord. Instead, a reusable cord adapter and insulating boot assembly 34 is designed to receive a separate, universal electric cord 23, as shown in FIG. 3, of either the reusable or single-use type.

Figure 4:
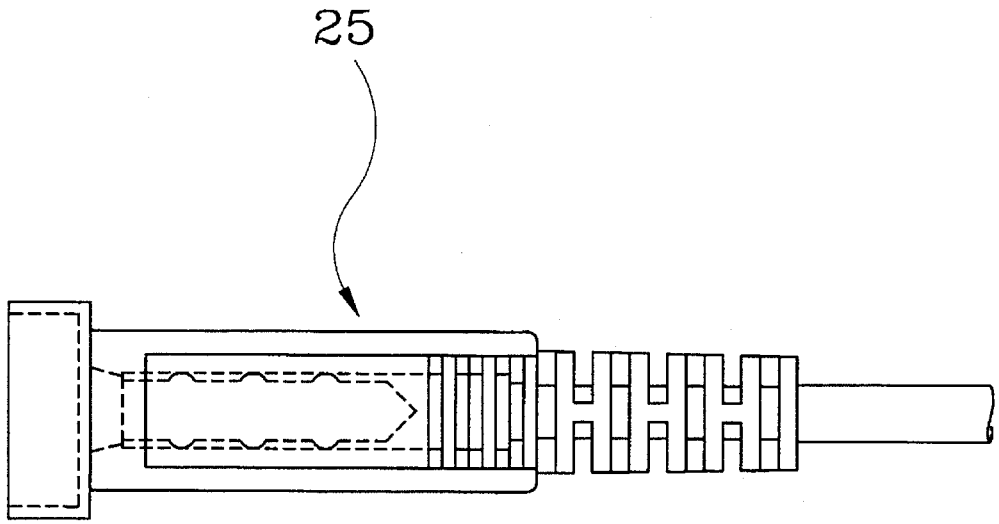
FIG. 4 is a side elevational view of a universal cord with a protective shroud to be fitted on the cord adapter shown in FIG. 2.

The second embodiment of the invention will be now be described in detail, it being noted that the same reference numbers as used in FIG. 1 will be used to identify identical parts in FIG. 2. As in the first embodiment, an electrical connecting portion 16 and an insulating boot 24 are integrally formed to comprise the assembly. The electrical connecting portion has a channel 18 open at its front end 20 and a female socket 22 set within the channel for receiving electrical pin 19 of the electrosurgical device. Extending from the back end of the electrical connection portion is an electrical pin 36 for receiving the universal cord. A shroud 38 can be provided on the proximal end of the electrical connecting portion for receiving the distal end of the electrical cord. The shroud provides further protection from current arcing or leaking from the connection between electrical pin 36 and the electrical cord. As an alternative, a shroud 25 can instead be provided on the distal end of the electrical cord as shown in FIG. 4.

The reusable cord and insulating boot assembly of the first embodiment and the reusable cord adapter and insulating boot assembly of the second embodiment are made of plastic, rubber, or other suitable insulating material, except for the metallic conductive parts for carrying electrical current to the endoscopic electrosurgical device. These embodiments are ideally suited for use with the PRESTIGE™ line of electrosurgical dissectors. However, both assemblies can be readily used with other electrosurgical devices for the purpose of preventing electrical shock to the surgeon/user.

Although specific embodiments of the present invention have been described above in detail, it will be understood that this description is merely for purposes of illustration. Various modifications of and equivalent structures corresponding to the disclosed aspects of the preferred embodiment in addition to those described above may be made by those skilled in the art without departing from the spirit of the present invention which is defined in the following claims, the scope of which is to be accorded the broadest interpretation so as to encompass such modifications and equivalent structures.

What is claimed is:

1. An electrosurgical adapter assembly for use in conjunction with an electrosurgical device, said device having a conducting pin projecting therefrom and a portion manipulable by a surgeon to actuate the device; said adapter assembly comprising:

a single electrically conductive connecting portion defining a single channel open at a first end, for receiving the electrical pin on the electrosurgical device, and having a single electrical pin extending therefrom to be connected to an electrical cord; and an insulating boot having two opposing lateral sides extending from said electrical connecting portion, a closed back end and an open front end, and being configured to fit over at least a part of the manipulable portion of the electrosurgical device.

2. An electrosurgical adapter assembly according to claim 1, further comprising a shroud integrally formed on a proximal end of said electrical connecting portion and encircling part of said adapter electrical pin extending from said electrical connecting portion.

3. An electrosurgical adapter assembly according to claim 1, further comprising a conductive female socket disposed in said channel for receiving the electrical pin on the electrosurgical device.

4. An electrosurgical adapter assembly according to claim 1, wherein said lateral sides are shaped to cover electrically conductive parts of the manipulable portion of the electrosurgical device.

* * * * *